United States Patent [19]

Rusznyak

[11] Patent Number: 5,027,054

[45] Date of Patent: Jun. 25, 1991

[54] THRESHOLD DEPENDENT VOLTAGE SOURCE

[75] Inventor: Andreas Rusznyak, Geneva, Switzerland

[73] Assignee: Motorola, Inc., Schaumburg, Ill.

[21] Appl. No.: 415,210

[22] PCT Filed: Oct. 20, 1988

[86] PCT No.: PCT/EP88/00940

§ 371 Date: Sep. 5, 1989

§ 102(e) Date: Sep. 5, 1989

[87] PCT Pub. No.: WO89/06837

PCT Pub. Date: Jul. 27, 1989

[30] Foreign Application Priority Data

Jan. 13, 1988 [GB] United Kingdom ..... 8800703

[51] Int. Cl.[5] ..... G05F 3/20

[52] U.S. Cl. ..... 323/314; 323/316

[58] Field of Search ..... 323/311, 313, 314, 315, 323/316

[56] References Cited

U.S. PATENT DOCUMENTS

| | | | |
|---|---|---|---|
| 4,588,941 | 5/1986 | Kerth et al. | 323/314 |
| 4,638,239 | 1/1987 | Hachimori | 323/314 |
| 4,675,593 | 6/1987 | Minakuchi | 323/314 |
| 4,713,600 | 12/1987 | Tsugaru et al. | 323/314 |
| 4,751,463 | 6/1988 | Higgs et al. | 323/314 |

*Primary Examiner*—Peter S. Wong

*Attorney, Agent, or Firm*—Michael D. Bingham; Bradley J. Botsch

[57] ABSTRACT

A circuit for generating voltages having values proportional to the threshold voltages ($V_T$) of n-channel transistors used in the circuit comprises a current mirror $M_2$, $M_3$ having a reference current input generated from a reference voltage of value $2V_t$ by an n-channel transistor $M_1$. The output reference voltage of value $2V_T$ by an n-channel transistor $M_4$ whose gate is coupled either to its drain, for output voltages greater than $V_T$, or to the gate of transistor $M_1$ for output voltages less then $V_T$.

8 Claims, 2 Drawing Sheets

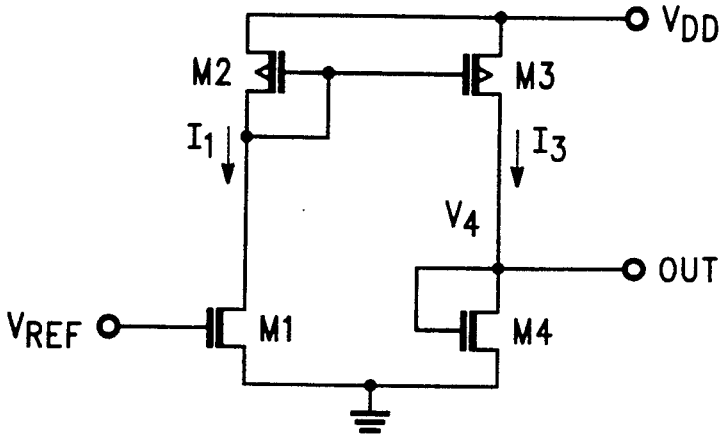
FIG. 1a
FIG. 2a
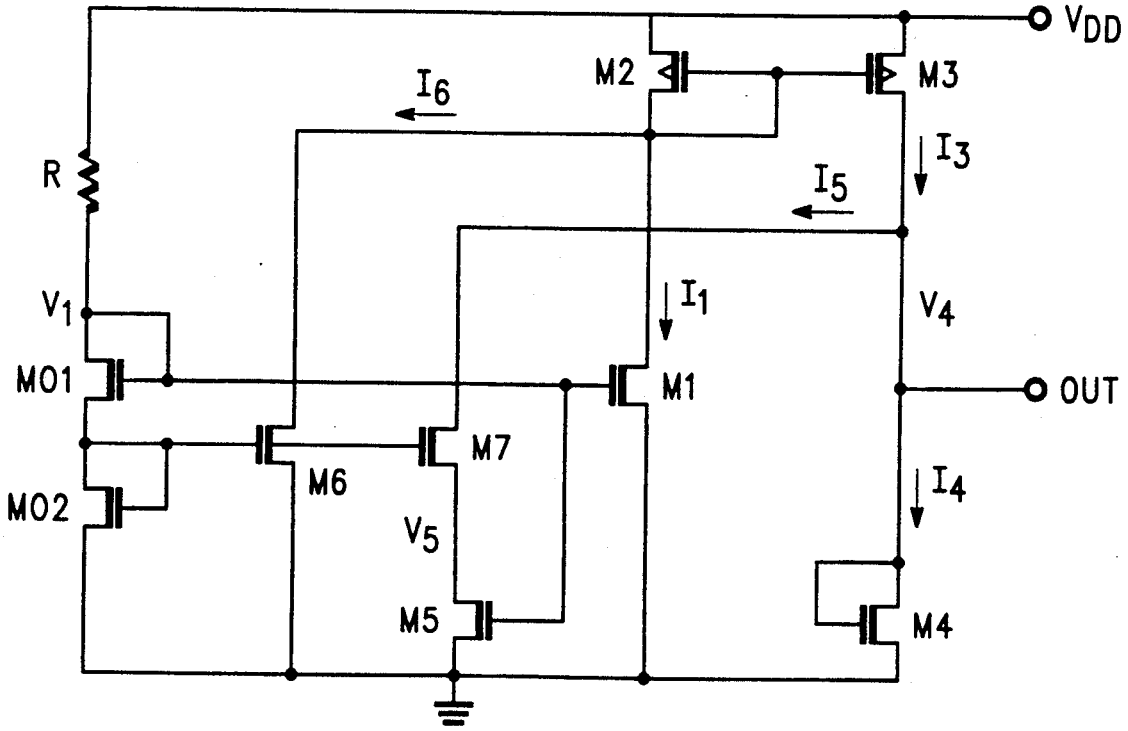

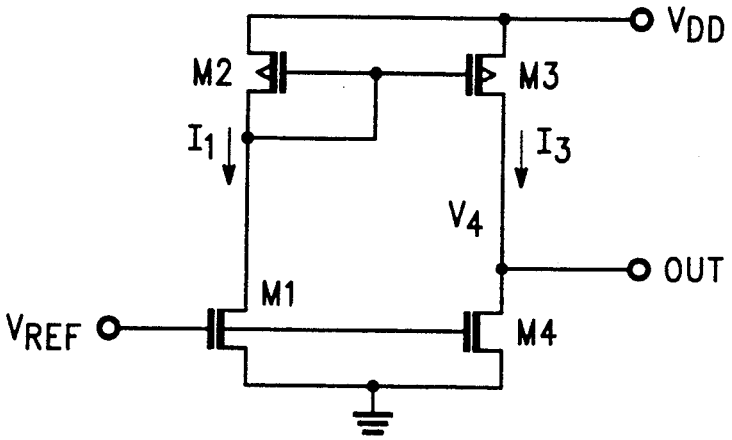
FIG. 1b
FIG. 2b
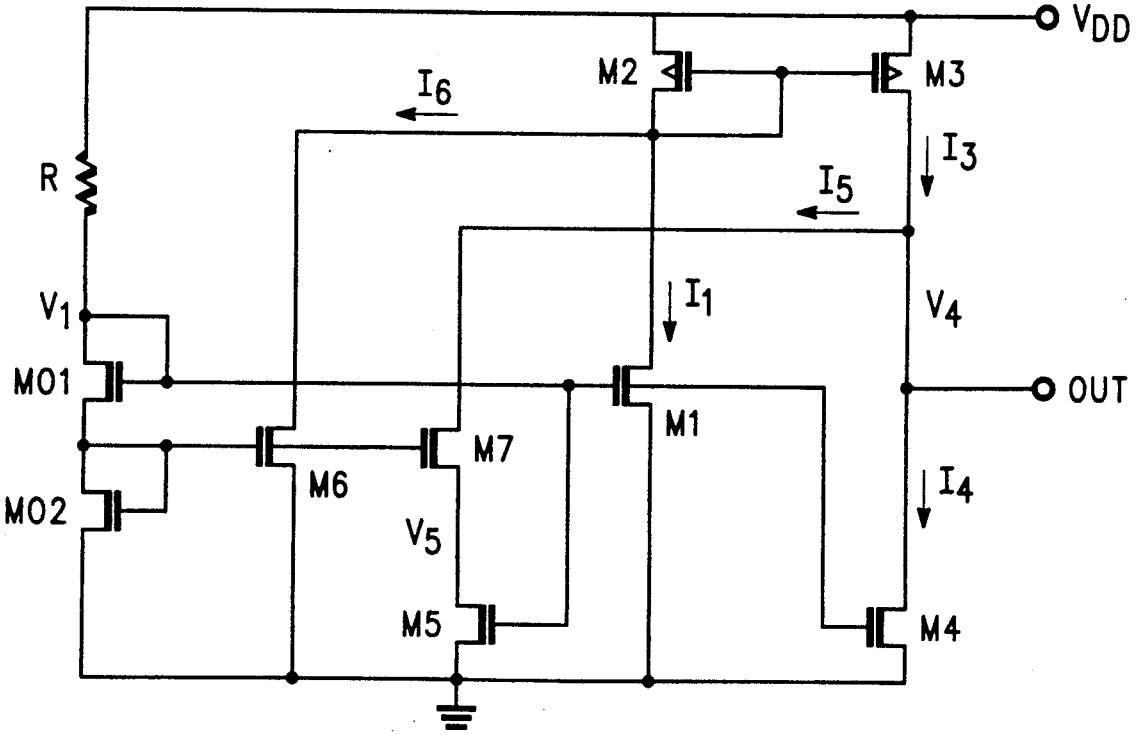

THRESHOLD DEPENDENT VOLTAGE SOURCE

BACKGROUND OF THE INVENTION

This invention relates to voltage sources and particularly to circuits which provide specific voltages which are dependent on the threshold voltage of transistors used in the circuit.

Such circuits are particularly useful in the field of CMOS IC's where it is advantageous to provide specific voltages whose values are proportional to the threshold voltage $V_T$ of the transistors used therein. Such transistors may be either n- or p-channel field-effect transistors. One application is in logic circuits where threshold voltage dependent voltages are required in order to switch the transistors in the circuit so that logical decisions are made by the circuit. Another application is in sensing amplifiers in which lines connected to the inputs of the amplifier are precharged by voltages proportional to the threshold voltage in order to improve the sensitivity of the amplifier.

SUMMARY OF THE INVENTION

Therefore it is an object of the invention to provide a circuit which generates voltages whose values are proportional to the threshold voltage of the transistors used in the circuit.

Accordingly, the invention provides a voltage source circuit comprising a current mirror having an input and an output and coupled to a first reference potential line;

a reference current source coupled to the current mirror input or generating a reference current which is proportional to a threshold voltage; and a bias transistor having a first current electrode coupled to the current mirror output, a second current electrode coupled to a second reference potential line and a control electrode coupled so as to produce at its first current electrode a voltage dependent on the reference current, wherein said current mirror output forms an output of the voltage source circuit.

Preferably the reference current source comprises a transistor having a first current electrode coupled to said current mirror input, a second current electrode coupled to said second reference potential line and a control electrode for receiving on input reference voltage.

As will be more fully described below, the control electrode of the bias transistor may be coupled to received either the input reference voltage or the voltage level at the current mirror output, depending on the required output from the voltage source circuit.

BRIEF DESCRIPTION OF THE DRAWINGS

The invention will now be more fully described by way of example with reference to the drawings of which:

FIGS. 1A and 1B show circuit diagrams of a basic embodiment of a voltage source circuit according to the invention; and FIGS. 2A and 2B show circuit diagrams of an improved embodiment of a voltage source circuit according to the invention.

DETAILED DESCRIPTION OF THE INVENTION

Thus, FIGS. 1A and 1B show circuit diagrams of a voltage source circuit providing voltages which are dependent on the threshold voltage of n-channel transistors. It comprises a current mirror composed of p-channel transistors $M_2$ and $M_3$ each having one current electrode coupled to a voltage supply line $V_{DD}$. Transistor $M_2$ is diode-coupled with its second current electrode coupled to its gate electrode which is also coupled to the gate electrode of transistor $M_3$. The input to the current mirror comprises the second current electrode of transistor $M_2$ which is coupled to the first current electrode of an n-channel transistor $M_1$. This transistor has its second current electrode coupled to a ground reference potential line and its gate electrode coupled to receive an input reference voltage $V_{REF}$.

In this embodiment of the voltage source circuit, the input reference voltage $V_{REF}$ is arranged to be twice the threshold $V_T$ of the n-channel transistors. Thus:

$$V_{REF}=2\,V_T \tag{0}$$

Since the current I through a transistor having a threshold voltage $V_T$ and biased by a voltage V is described by $$I=K\,(V-V_T)^2$$

where K is the transistor gain constant, the current through transistor M1 is $$I_1=K_1\,(2\,V_T-V_T)^2=K_1\,V_T^2 \tag{1}$$

This is the current input to the current mirror and the current output from the mirror through transistor $M_3$ is:

$$I_3=x\,I_1=x\,K_1V_T^2 \tag{2}$$

where x is a constant determined by the geometry ratios of transistors $M_2$ and $M_3$.

The output of the current mirror is coupled to the drain of an n-channel bias transistor $M_4$, this drain forming the output of the voltage source circuit. The source of transistor $M_4$ is coupled to the ground reference potential line and the gate of transistor $M_4$ is connected either to its own drain (FIG. 1A) of the gate electrode of transistor $M_1$ (FIG. 1B) depending on the output voltage required from the voltage source circuit.

If the gate electrode of transistor $M_4$ is coupled to its drain, as shown in FIG. 1A its drain source voltage $V_4$ is determined by:

$$I_3=K_4\,(V_4-V_T)^2 \tag{3}$$

Rearranging this, gives:

$$V_4 = V_T + \sqrt{I_3/K_4} \tag{4}$$

Substituting for $I_3$ from equation (2) gives:

$$\begin{aligned} V_4 &= V_T + \sqrt{xK_1V_T^2/K_4} \\ &= V_T(1 + \sqrt{xK_1/K_4}\,) \end{aligned} \tag{5}$$

Thus the output voltage $V_4$ can be made to be any predetermined ratio of $V_T$ greater than one by appropriately choosing $xK_{1/K_4}$.

Similarly, if the gate electrode of transistor $M_4$ is coupled to the gate electrode of transistor $M_1$ as shown in FIG. 1B, the transistor $M_4$ can be made to operate in the triode region. In this case, the output voltage $V_4$ is given by:

$$I_3 = K_4[2(2V_T - V_T)V_4 - V_4^2] = K_4(2V_TV_4 - V_4^2) \quad (6)$$

Substituting for $I_3$ from equation (2) gives:

$$V_4^2 - 2V_TV_4 + xK_1V_T^2/K_4 = 0 \quad (7)$$

whose solution is:

$$V_4 = V_T(1 - \sqrt{1 - xK_1/K_4}) \quad (8)$$

From this it can be seen that the output voltage $V_4$ can now be made to be lower than the threshold voltage $V_T$ by appropriate choices of x, $K_1$ and $K_4$.

Thus, by coupling the gate of transistor $M_4$ to the gate of the transistor $M_1$, the ratio $V_4/V_T$ is less than one and by coupling the gate of transistor $M_4$ to the drain of transistor $M_4$, the ratio $V_4/V_T$ is greater than one.

Although the above calculations were performed for $V_{REF}=2V_T$, it will be appreciated that a similar result will be obtained for $V_{REF}$ being any value $(n+1).V_T$. In this case:

$$I_1 = K_1((n+1)V_T - V_T)^2 = K_1(nV_T)^2 \quad (9)$$

so that for the gate of the transistor $M_4$ being coupled to its drain we have, similarly to equations (2) and (3):

$$I_3 = xI_1 = xK_1(nV_T)^2 = K_4(V_4 - V_T)^2$$

Thus:

$$(V_4 - V_T)^2$$

giving:

$$\sqrt{xK_1/K_4}\, nV_T = V_4 - V_T$$

so that $$V_4 = V_T[1 + n\sqrt{xK_1/K_4}] \quad (10)$$

To generate a current in transistor $M_1$, n must be greater than zero. However when $V_{REF}$ is generated by diode-connected transistors connected in series, to realise ratios $V_{REF}/V_T$ larger than two i.e. three or four or more, requires higher values of the supply voltage $V_{DD}$. Therefore a useful compromise is to set $V_{REF}=2V_T$.

One circuit in which a voltage $V_{REF}$ with a value of approximately $2V_T$ is generated is shown in FIGS. 2A and 2B. In these Figures transistors $M_1$–$M_4$ are equivalent to those in FIGS. 1A and 1B, respectively and the output voltage is $V_4$. The reference voltage $V_{REF}=V_1$ is generated by resistor R and by transistors $M_{01}$, $M_{02}$, connected in series between voltage supply line $V_{DD}$ and reference potential line. However, the reference voltage $V_{REF}$ will not be exactly $2V_T$ because of transistors $M_{01}$ and $M_{02}$ which are diode-coupled, across which the voltage will be:

$$V_1 = 2V_T + 2\sqrt{I_0/K_0} \quad (11)$$

where $I_o$ is the current through the transistors $M_{01}$ and $M_{02}$ and $K_0$ is their gain constant.

However neither $I_0$ nor $K_0$ can be considered as having constant values since $I_0$ depends on the supply voltage $V_{DD}$ and $K_0$ is a function of process parameters and temperature. In the circuit of FIG. 1 and referring to equation (0) the current $I_3$ controlled by voltage $V_1$ would be:

$$I_3 = xK_1(V_T + 2\sqrt{I_0/K_0})^2 = xK_1(V_T^2 + 4V_T\sqrt{I_0/K_0} + 4I_0/K_0) \quad (12)$$

This current will be fed to transistor $M_4$.

To obtain a precise ratio of $V_4/V_T$ equal to $xK_1V_T^2$ the current $I_3$ must therefore be lowered by a value equal to:

$$xK_1(4V_T\sqrt{I_0/K_0} + 4I_0/K_0)$$

As shown in FIGS. 2A and 2B, a current of this value can be subtracted from $I_3$ using additional transistors $M_5$, $M_6$ and $M_7$. Transistors $M_5$ and $M_7$ are coupled in series between the ground reference potential line and the output of the current mirror composed of transistors $M_2$ and $M_3$. The gate of transistor $M_5$ is coupled the gate of transistor $M_1$ and the gate of transistor $M_7$ is coupled to the junction between transistors $M_{01}$ and $M_{02}$. Transistor $M_6$ is coupled between the ground reference potential line and the input of the current mirror with its gate coupled to the gate of transistor $M_7$.

Transistor $M_7$ has a wide channel and acts as a voltage follower. Its output voltage $V_5$ is given by:

$$V_5 \approx \sqrt{I_0/K_0} \quad (13)$$

The current $I_5$ through transistor $M_5$ operating in the triode region is:

$$I_5 = K_5[2(V_T + 2\sqrt{I_0/K_0})V_5 - V_5^2]$$

which gives from equation (13):

$$I_5 = K_5(2V_T\sqrt{I_0/K_0} + 3I_0/K_0) \quad (14)$$

By setting:

$$K_5 = 2xK_1$$

gives:

$$I_5 = 2xK_1(2V_T\sqrt{I_0/K_0} + 3I_0/K_0) \quad (15)$$

Now subtracting $I_5$ from $I_3$ gives:

$$I_3 - I_5 = xK_1 (V_T^2 - 2 I_{0/K0}) \quad (16)$$

This is close to the required value of $xK_1V_T^2$ but still requires the cancellation of the 2 $I_{0/K0}$ term in order to achieve very high precision for the ratio $V_{4/VT}$.

This can be achieved by adding to current $I_1$ a current $I_6$ flowing through transistor $M_6$. By setting $K_6 = 2K_1$ then:

$$I_4 = x\,[I_1 + I_6] - I_5 = xK_1V_T^2 \quad (17)$$

Current $I_4$ flowing through transistor $M_4$ now has the required value and generates a voltage:

$$V_4 = V_T(1 + \sqrt{xK_1/K_4}) \geqq V_T$$

if its gate is connected to its drain as shown FIG. 2A or:

$$V_4 = V_T(1 - \sqrt{1 - xK_1/K_4}) \leqq V_T$$

if its gate is connected to the gate of the transistor $M_1$ as shown in FIG. 2B.

The above description refers to an embodiment of the circuit according to the invention in which voltages are generated whose value is proportional to the threshold voltage of the n-channel transistors. To generate voltages proportional to the threshold voltage of the p-channel transistors a circuit complementary to that described above may be used.

I claim:

1. A voltage source circuit comprising:

a current mirror having an input and an output and coupled to a first reference potential line;

a reference current source coupled to the current mirror input for generating a reference current which is proportional to a threshold voltage; and a bias transistor having a first current electrode coupled to the current mirror output, a second current electrode coupled to a second reference potential line and a control electrode coupled so as to produce at its first current electrode a voltage dependent on the reference current, wherein said current mirror output forms an output of the voltage source circuit.

2. A voltage source circuit according to claim 1 wherein said reference current source comprises a transistor having a first current electrode coupled to said current mirror input, a second current electrode coupled to said second reference potential line and a control electrode for receiving an input reference voltage which is proportional to the threshold voltage of said transistor of said reference current source.

3. A voltage source circuit according to claim 2 wherein said input reference voltage has a value of substantially twice the threshold voltage of the transistor forming the reference current source.

4. A voltage source circuit according to either claim 2 or claim 3 wherein the control electrode of said bias transistor is coupled to receive said input reference voltage.

5. A voltage source circuit according to either claim 2 or claim 3 wherein the control electrode of said bias transistor is coupled to said current mirror output.

6. A voltage source circuit according to claim 3 wherein said input reference voltage is produced at the gate electrode of a first diode-coupled transistor coupled via a second diode-coupled transistor to said second reference potential line.

7. A voltage source circuit according to claim 6 further comprising means for adjusting the currents at the input and output of the current mirror in order to correct the voltage at the output of the voltage source circuit.

8. A voltage source circuit according to claim 7 wherein the adjusting means comprises a first adjusting transistor coupled in series between said current mirror output and the first current electrode of a second adjusting transistor, the second adjusting transistor having a second current electrode coupled to said second reference potential line, and a gate electrode coupled to receive said input reference voltage and the gate electrode of the first adjusting transistor being coupled to the gate electrode of said second diode-coupled transistor, so as to subtract an adjusting current from the current produced at the output of the current mirror.

* * * * *